US009168535B2

(12) United States Patent
Roozeboom et al.

(10) Patent No.: US 9,168,535 B2
(45) Date of Patent: Oct. 27, 2015

(54) ADJUSTABLE ANVIL FOR COMMINUTING APPARATUS

(71) Applicant: Vermeer Manufacturing Company, Pella, IA (US)

(72) Inventors: Keith Leon Roozeboom, Pella, IA (US); Joseph Edward Breja, Pella, IA (US)

(73) Assignee: VERMEER MANUFACTURING COMPANY, Pella, IA (US)

( * ) Notice: Subject to any disclaimer, the term of this patent is extended or adjusted under 35 U.S.C. 154(b) by 332 days.

(21) Appl. No.: 13/872,737

(22) Filed: Apr. 29, 2013

(65) Prior Publication Data

US 2014/0319250 A1 Oct. 30, 2014

(51) Int. Cl.

| | |
|---|---|
| ***B02C 18/22*** | (2006.01) |
| ***B02C 13/09*** | (2006.01) |
| ***B02C 18/14*** | (2006.01) |
| *B02C 18/18* | (2006.01) |

(52) U.S. Cl.

CPC ..... *B02C 13/095* (2013.01); *B02C 18/145* (2013.01); *B02C 18/22* (2013.01); *B02C 2018/188* (2013.01)

(58) Field of Classification Search

CPC .... B02C 13/095; B02C 18/22; B02C 18/225; B02C 18/2241; B02C 18/145; B02C 2018/188

USPC ..... 241/242, 243, 286, 222

See application file for complete search history.

(56) References Cited

U.S. PATENT DOCUMENTS

| | | | |
|---|---|---|---|
| 4,771,953 | A | 9/1988 | Morey |
| 5,713,525 | A | 2/1998 | Morey |
| 5,775,608 | A | 7/1998 | Dumaine et al. |
| 5,785,263 | A | 7/1998 | Wu et al. |
| 5,819,825 | A | 10/1998 | Lyman et al. |
| 5,971,305 | A | 10/1999 | Davenport |
| 5,975,443 | A | 11/1999 | Hundt et al. |
| 6,016,979 | A | 1/2000 | Squires et al. |
| 6,094,795 | A | 8/2000 | Davenport |
| 6,565,026 | B1 | 5/2003 | Hall |
| 7,448,568 | B2 | 11/2008 | Katsumura et al. |
| 7,757,988 | B2 | 7/2010 | Pallmann et al. |
| 7,971,818 | B2 | 7/2011 | Smidt et al. |
| 8,104,701 | B2 | 1/2012 | Smidt et al. |
| 8,333,339 | B2 | 12/2012 | Pallmann |
| 2005/0184178 | A1 | 8/2005 | Smidt et al. |
| 2009/0242677 | A1 | 10/2009 | Smidt et al. |

FOREIGN PATENT DOCUMENTS

| | | | |
|---|---|---|---|
| DE | 3106686 | A1 | 7/1982 |
| DE | 202005013719 | U1 | 4/2006 |
| EP | 1304169 | B1 | 10/2002 |
| EP | 1927402 | A1 | 11/2007 |
| EP | 2025410 | A1 | 7/2008 |
| WO | 9325311 | A1 | 12/1993 |
| WO | 2008126086 | A2 | 10/2008 |
| WO | 2012074790 | A2 | 6/2012 |

OTHER PUBLICATIONS

European Search Report, Application No. 14165268.5, dated Jun. 17, 2014, pp. 6.

*Primary Examiner* — Mark Rosenbaum

(74) *Attorney, Agent, or Firm* — Armstrong Teasdale LLP

(57) ABSTRACT

The field of the disclosure relates to anvils for comminuting apparatus such as grinders or chippers. In some embodiments, the anvil is adjustable in length to maintain a clearance between a comminuting drum and a shear edge of the anvil.

20 Claims, 14 Drawing Sheets

ADJUSTABLE ANVIL FOR COMMINUTING APPARATUS

CO-PENDING, CO-OWNED APPLICATIONS INCORPORATED HEREIN

The present application incorporates U.S. application Ser. No. 13/872,801, filed Apr. 29, 2013, entitled Cutter Assembly and Adjustable Cutter for use in Comminuting Apparatus and U.S. application Ser. No. 13/872,876, filed Apr. 29, 2013 entitled Mounting Block for Attaching a Reducing Element to a Rotary Drum, herein by reference for all relevant and consistent purposes.

FIELD OF THE DISCLOSURE

The field of the disclosure relates to anvils for comminuting apparatus such as grinders or chippers and, in particular, to anvils that are adjustable in length to maintain a clearance between the comminuting drum and a shear edge of the anvil.

BACKGROUND

Comminuting apparatus such as grinders and chippers are used to mechanically grind, chip or shred material to reduce the size of the material. Such apparatus may be used to reduce the size of material such as tree limbs, stumps or brush (i.e., arboraceous material) in land-clearing, municipal waste, composted materials or other vegetation, building materials or recycled material (e.g., car tires and the like). One common type of reducing machine is known as a horizontal grinder. A horizontal grinder may include a power in-feed mechanism that forces larger material (e.g., wood-based material such as tree trunks, tree branches, logs, etc.) into contact with a rotating comminuting drum. The larger material is contacted by reducing elements such as teeth, grinding elements or "knives" carried by the comminuting drum and portions of the material are forced past a fixed shear edge defined by an anvil of the horizontal grinder.

Upon passing the shear edge of the anvil, the material enters a chamber in which the material is further reduced by the reducing element carried by the comminuting drum. Once the material within the chamber is reduced in size, the material is discharged. Upon passing through the chamber, the reduced material is typically deposited on a discharge conveyor that carries the reduced material to a collection location. An example of a horizontal grinder is disclosed in U.S. Patent Publication No. 2009/0242677, which is incorporated herein by reference for all relevant and consistent purposes.

A continuing need exists for comminuting apparatus that maintain proper clearances between shear edges without replacement of comminuting components.

This section is intended to introduce the reader to various aspects of art that may be related to various aspects of the disclosure, which are described and/or claimed below. This discussion is believed to be helpful in providing the reader with background information to facilitate a better understanding of the various aspects of the present disclosure. Accordingly, it should be understood that these statements are to be read in this light, and not as admissions of prior art.

SUMMARY

One aspect of the present disclosure is directed to an adjustable anvil for a comminuting apparatus. The adjustable anvil includes a first plate having a trailing edge and a second plate having a leading edge. The first plate and second plate form an anvil work surface for bringing material into contact with a comminuting drum. The trailing edge of the first plate is adjacent the leading edge of the second plate. A margin is disposed between the trailing edge of the first plate and leading edge of the second plate. The margin has an adjustable length.

Various refinements exist of the features noted in relation to the above-mentioned aspects of the present disclosure. Further features may also be incorporated in the above-mentioned aspects of the present disclosure as well. These refinements and additional features may exist individually or in any combination. For instance, various features discussed below in relation to any of the illustrated embodiments of the present disclosure may be incorporated into any of the above-described aspects of the present disclosure, alone or in any combination.

BRIEF DESCRIPTION OF THE DRAWINGS

Corresponding reference characters indicate corresponding parts throughout the drawings.

DETAILED DESCRIPTION

Figure 1:
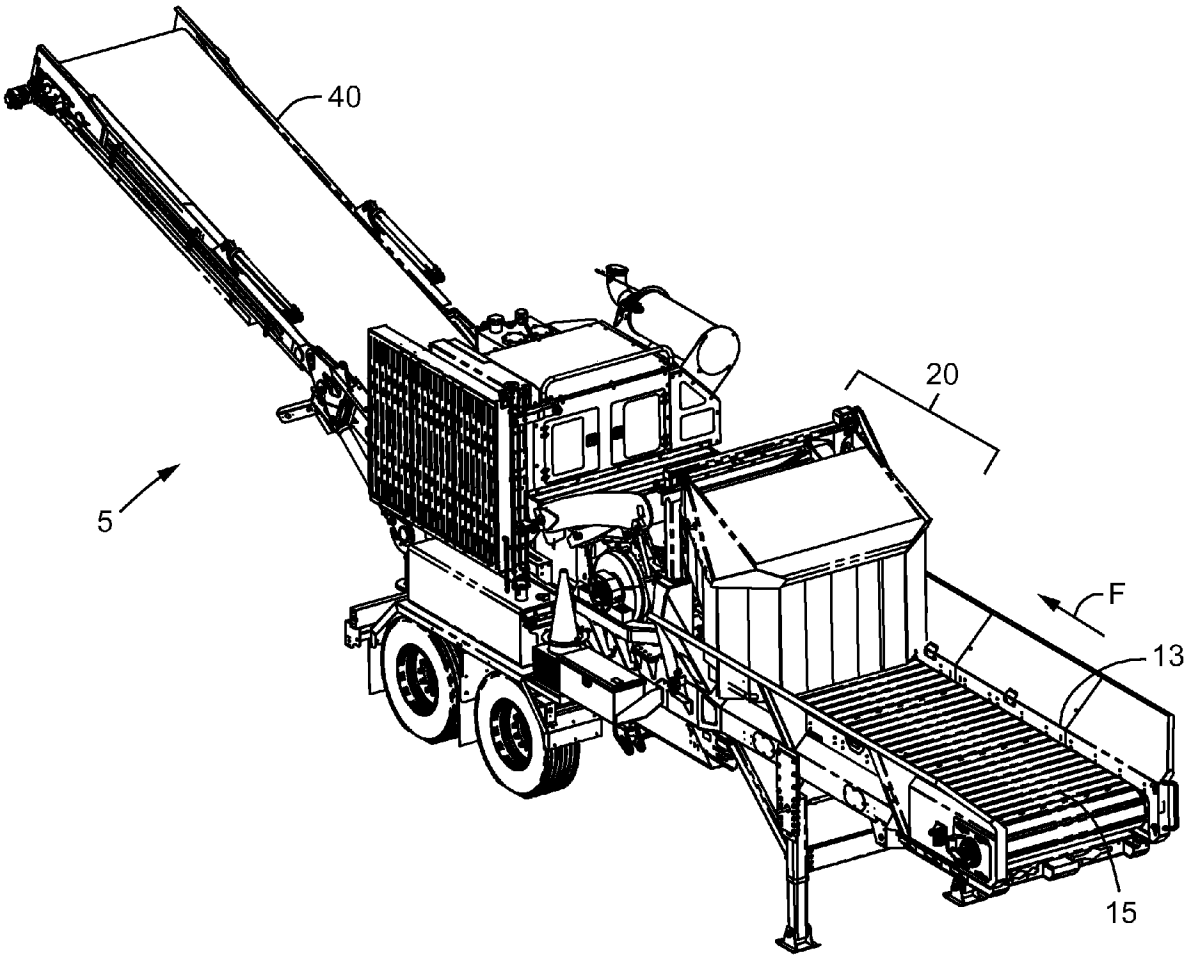
FIG. 1 is a perspective view of an apparatus for reducing the size of material.

An embodiment of a comminuting apparatus for reducing the size of material is generally referred to as "5" in FIG. 1. The apparatus 5 is depicted as a horizontal grinder having a power in-feed system 13, a comminuting assembly 20 and a discharge conveyor 40. While the present disclosure has been described with reference to a horizontal grinder, it should be noted that the principles described herein (e.g., an adjustable length anvil) may also apply to any suitable apparatus for comminuting material such as a wood chipper having a chute for discharging comminuted material.

Figure 2:
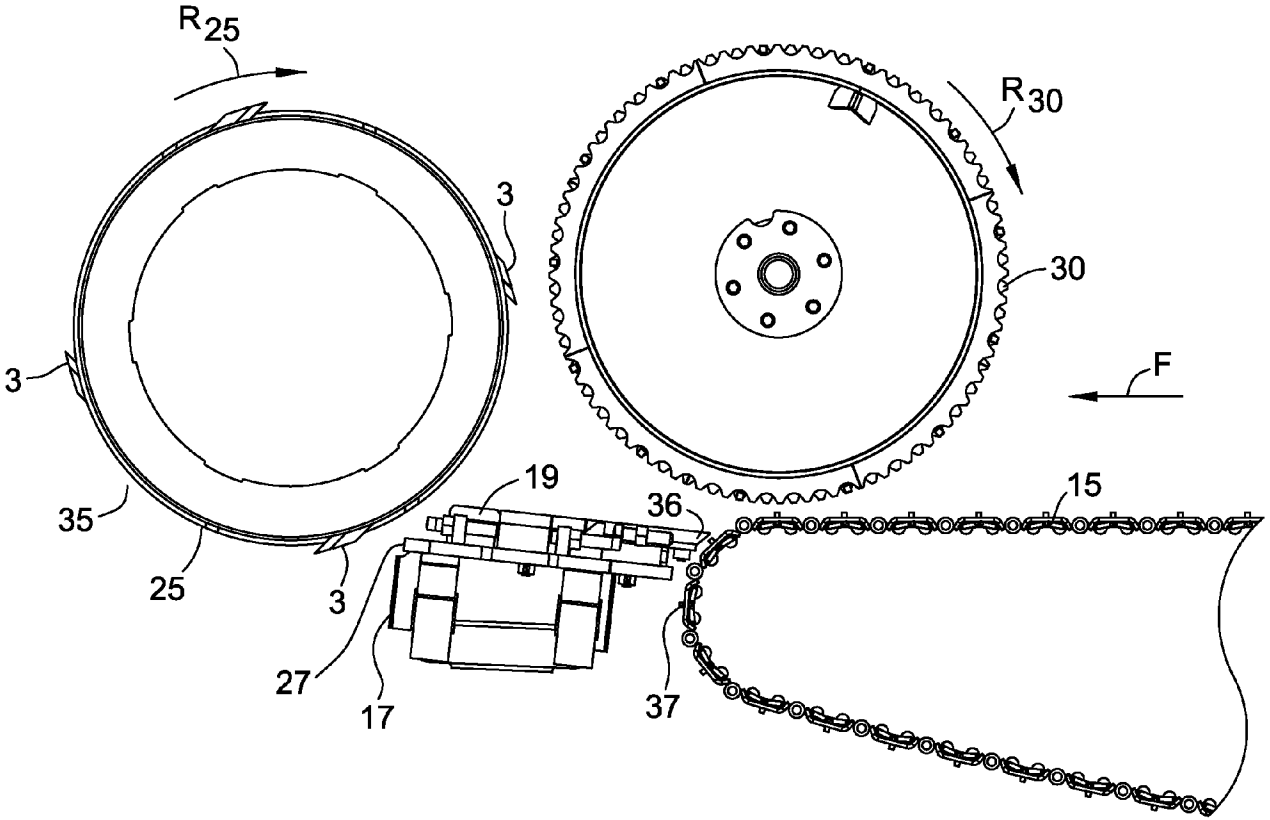
FIG. 2 is a side view of an in-feed system, anvil, feed roller and comminuting drum of the apparatus of FIG. 1.

The in-feed system 13 of the comminuting apparatus 5 includes an in-feed conveyor 15 (e.g., chain or belt) to move the material toward a comminuting drum 25 (FIG. 2) in a feed direction indicated by arrow F. As shown in FIG. 2, the in-feed system has a first end 37 proximal to an anvil 17. The anvil 17 is disposed between the conveyor 15 and a comminuting drum 25 to bridge the gap between the conveyor 15 and comminuting drum 25. A feed roller 30 rotates about an axis in direction $R_{30}$ to force material over the anvil 17 and to contact the comminuting drum 25. The anvil 17 includes a first end 36 adjacent the conveyor 15 and a second end 27 adjacent the drum 25.

The comminuting drum 25 carries a plurality of reducing elements 3 (e.g., teeth, blades, knives, etc. and/or combinations of these elements). During operation, the comminuting drum 25 rotates about an axis of rotation in direction $R_{25}$ such that the tips of the reducing elements 3 define a circumferential reducing path. In some embodiments (not shown), the apparatus may include a sizing screen that at least partially surrounds the comminuting drum 25 for forming a reducing chamber defined between the comminuting drum and the sizing screen. The principles of the present disclosure (e.g., use of an adjustable width anvil) may apply to apparatus that do not include such sizing screens such as the comminuting apparatus 5 described herein and may also apply to apparatus that include such sizing screens.

Figure 3:
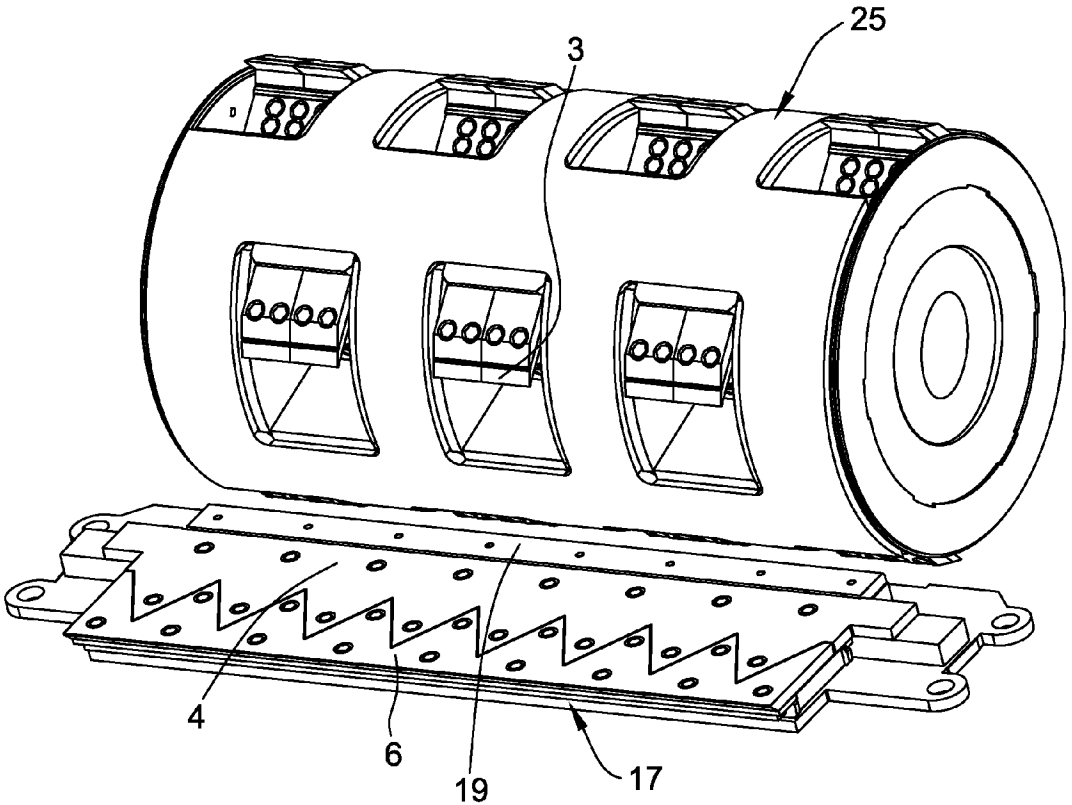
FIG. 3 is a perspective view of the anvil and comminuting drum.
Figure 4:
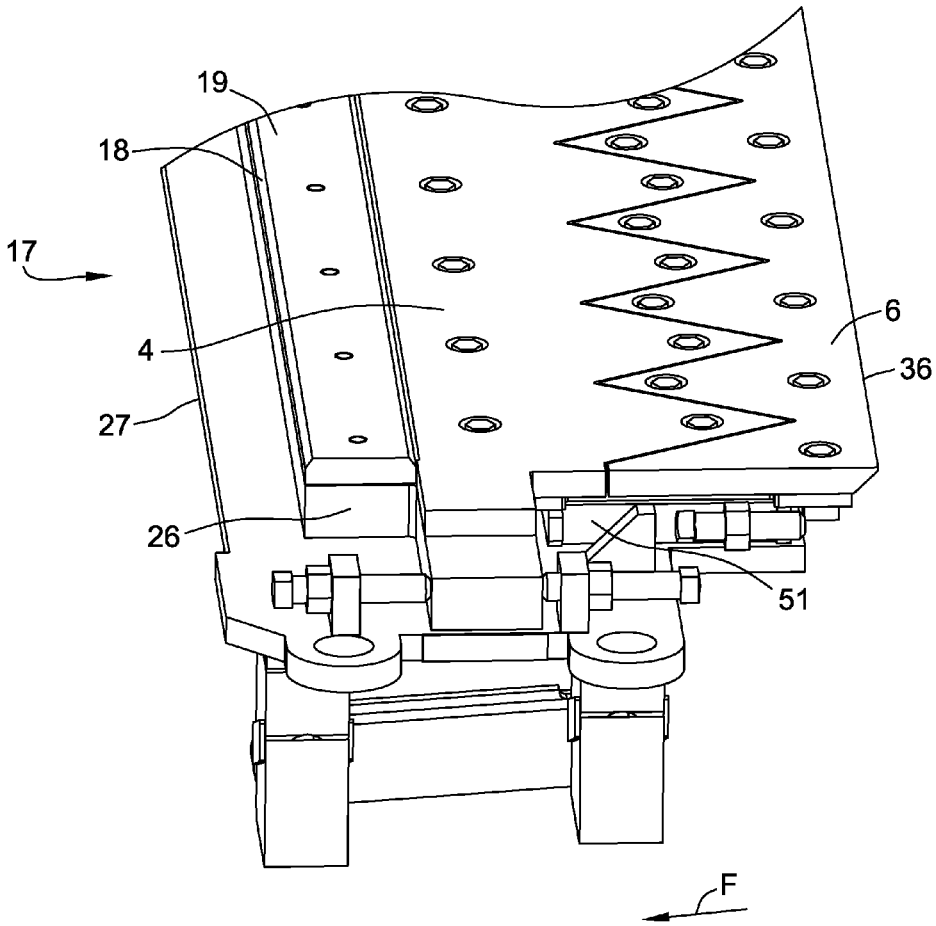
FIG. 4 is a perspective view of the anvil.
Figure 5:
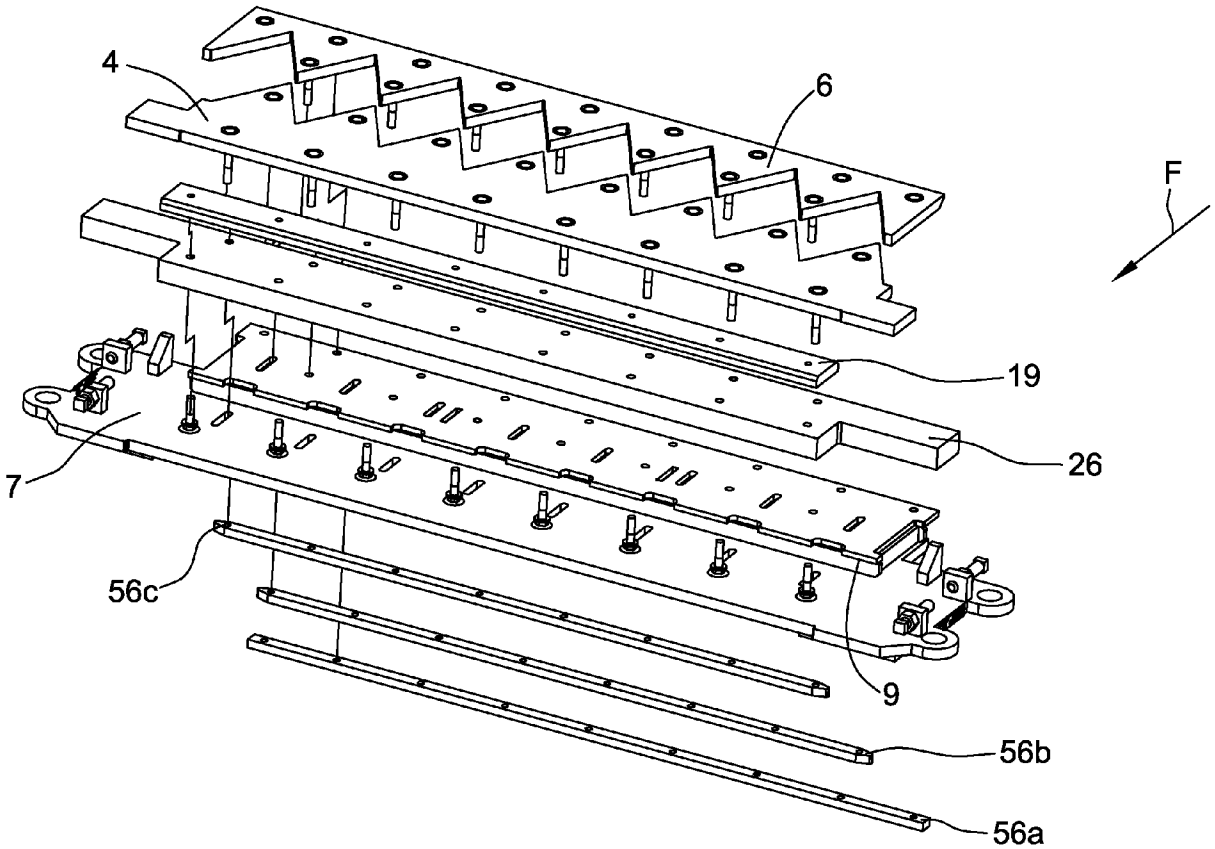
FIG. 5 is an exploded view of the anvil.

Referring now to FIGS. 3-5, the anvil 17 includes a first top plate 6 (or simply "first plate) and second top plate 4 (or simply "second plate"). The first top plate 6 (FIG. 6) includes a leading edge 22 (i.e., the edge over which material first passes along feed direction F) and an "undulating" or "serrated" trailing edge 16. The leading edge 22 of the first top plate 6 may have any suitable profile (e.g., may be essentially straight or serrated). The second top plate 4 (FIG. 7) has a serrated leading edge 14 and a trailing edge 23. The trailing edge 23 of the second top plate 4 should match the profile of the reducing elements 3 (e.g., essentially straight or serrated depending on the angle (if any) of the reducing elements).

Figure 8:
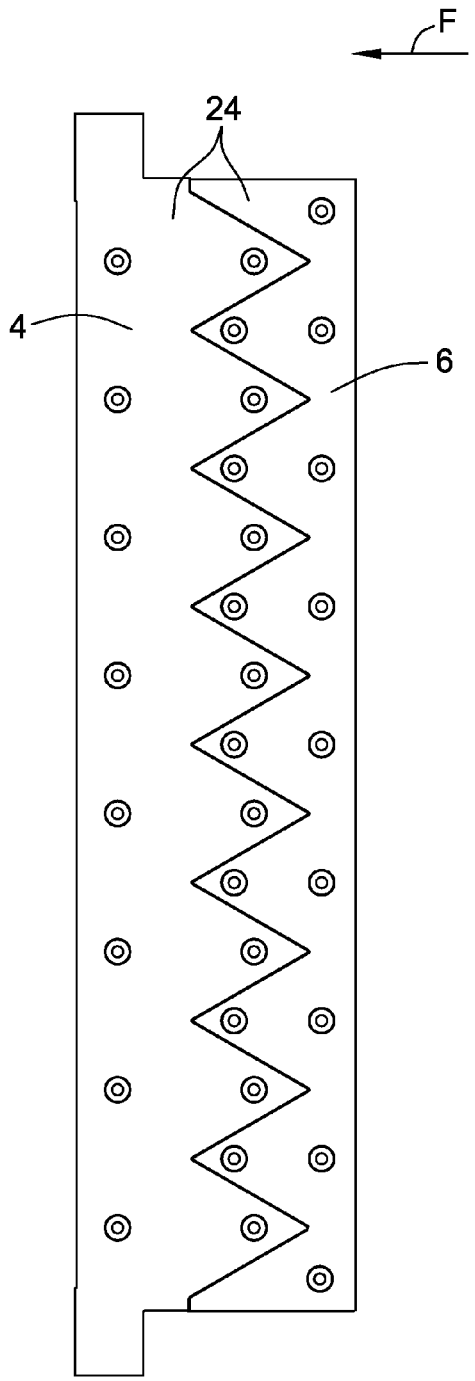
FIG. 8 is a top view of the first top plate and second top plate with the first top plate abutting the second top plate.
Figure 9:
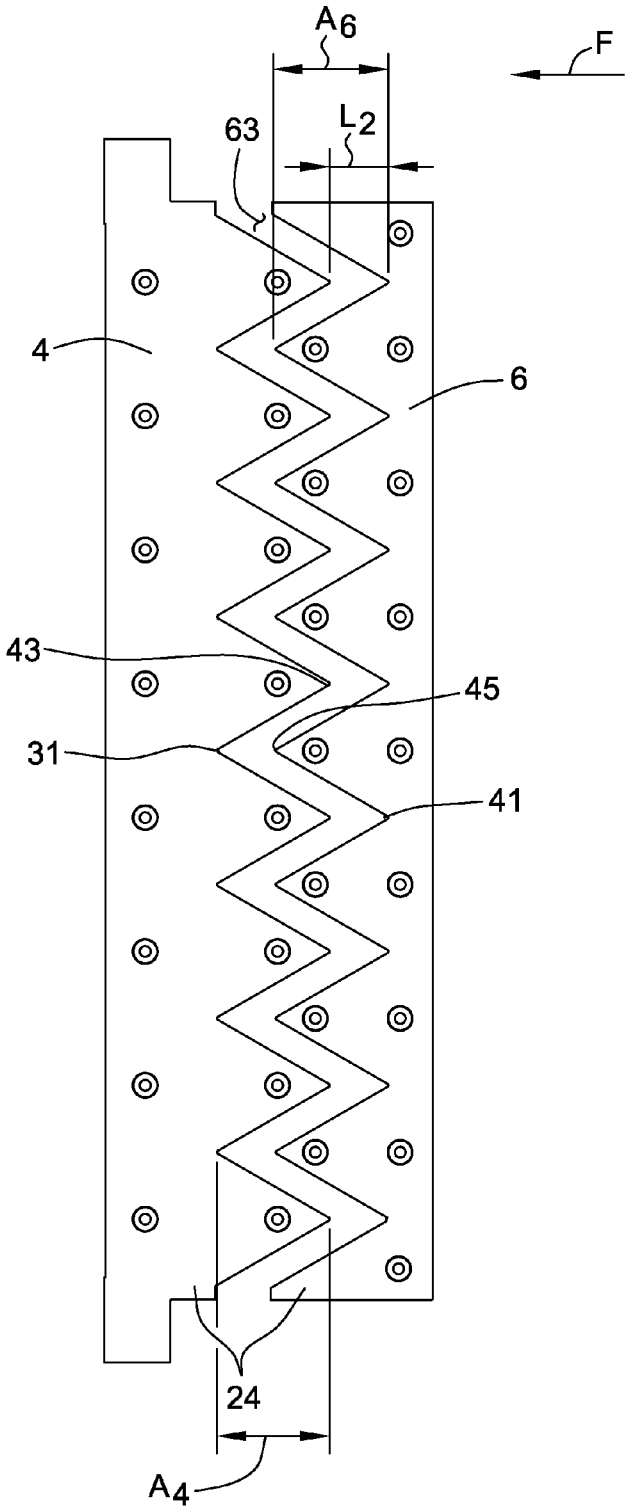
FIG. 9 is a top view of the first top plate and second top plate with a margin having a length $L_2$ separating the first top plate and second top plate.

The first top plate 6 and second top plate 4 form an anvil work surface 24 (FIG. 8) upon which material travels in feed direction F during operation. In this regard, the anvil work surface 24 may be continuous as shown in FIG. 8 or may be discontinuous (e.g., separated by a margin 63) as shown in FIG. 9 and discussed further below.

Figure 13:
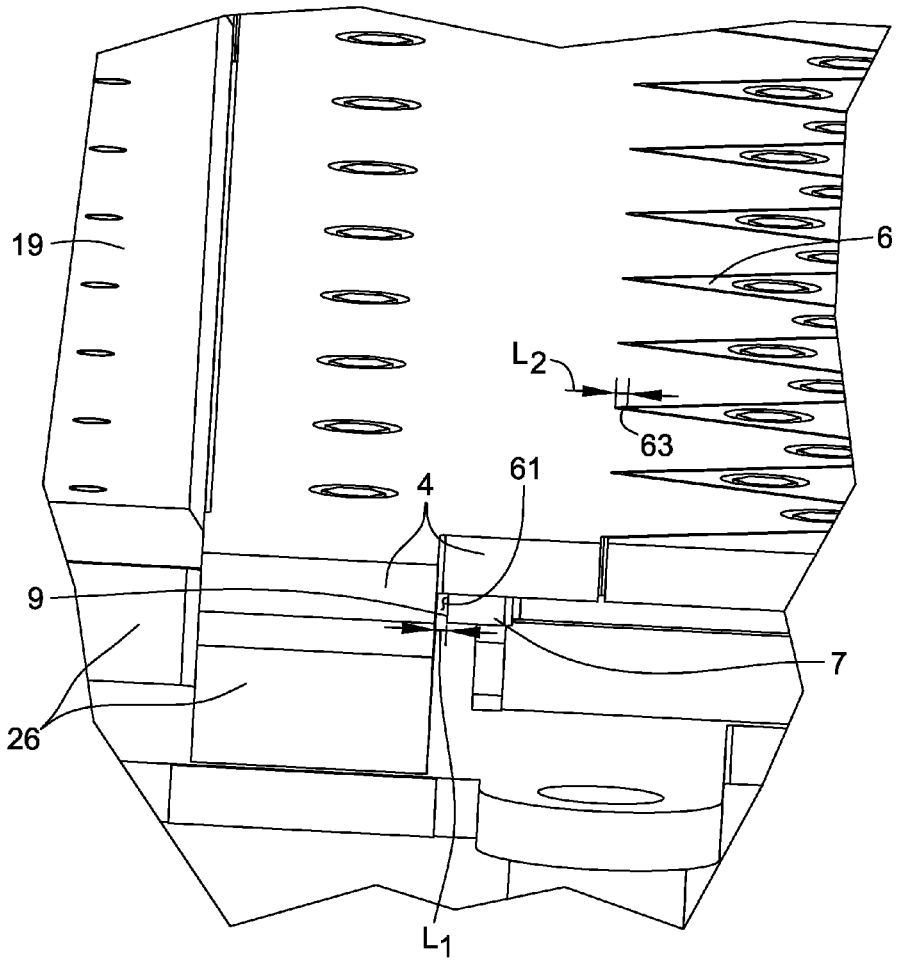
FIG. 13 is a perspective view of the anvil showing the top plate margin and support plate margin.

The trailing edge 16 of the first top plate 6 (FIG. 6) includes a series of projections 39 and indentations 41 that form a serrated zig-zag pattern along the edge. The leading edge 14 of the second top plate 4 (FIG. 7) also includes a series of projections 29 and indentations 31 that form a serrated "zig-zag" pattern along the edge. The projections 29 (FIG. 7) of the second top plate 4 align with the indentations 41 (FIG. 6) of the first top plate 6 and the projections 39 of the first top plate 6 align with the indentations 31 (FIG. 7) of the second top plate 4 which allows the plates 4, 6 to form a continuous anvil work surface 24 when fully adjoined (FIG. 8). Use of a first top plate 6 and second top plate 4 that have aligned projections and indentations (e.g., that from a "zig-zag" pattern) prevents elongated debris (e.g., sticks or twigs) from being trapped within the top plate margin 63 (FIG. 13). The first top plate 6 and/or second top plate 4 may include more or less projections 29, 39 and indentations 31, 41 than as shown in FIGS. 6-7 without departing from the scope of the present disclosure.

Figure 6:
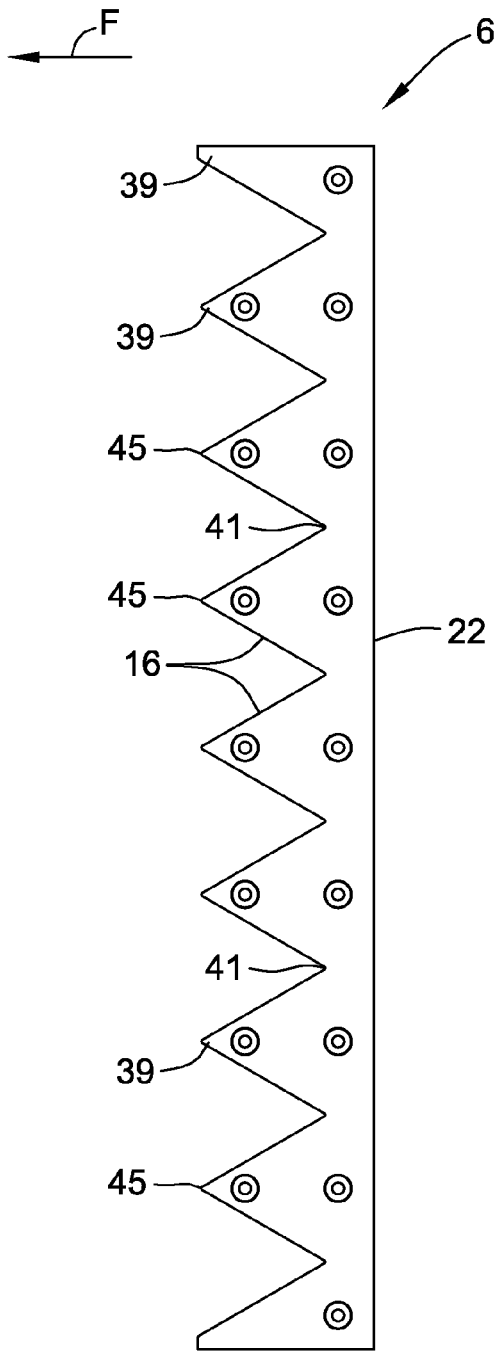
FIG. 6 is a top view of a first top plate of the anvil.
Figure 7:
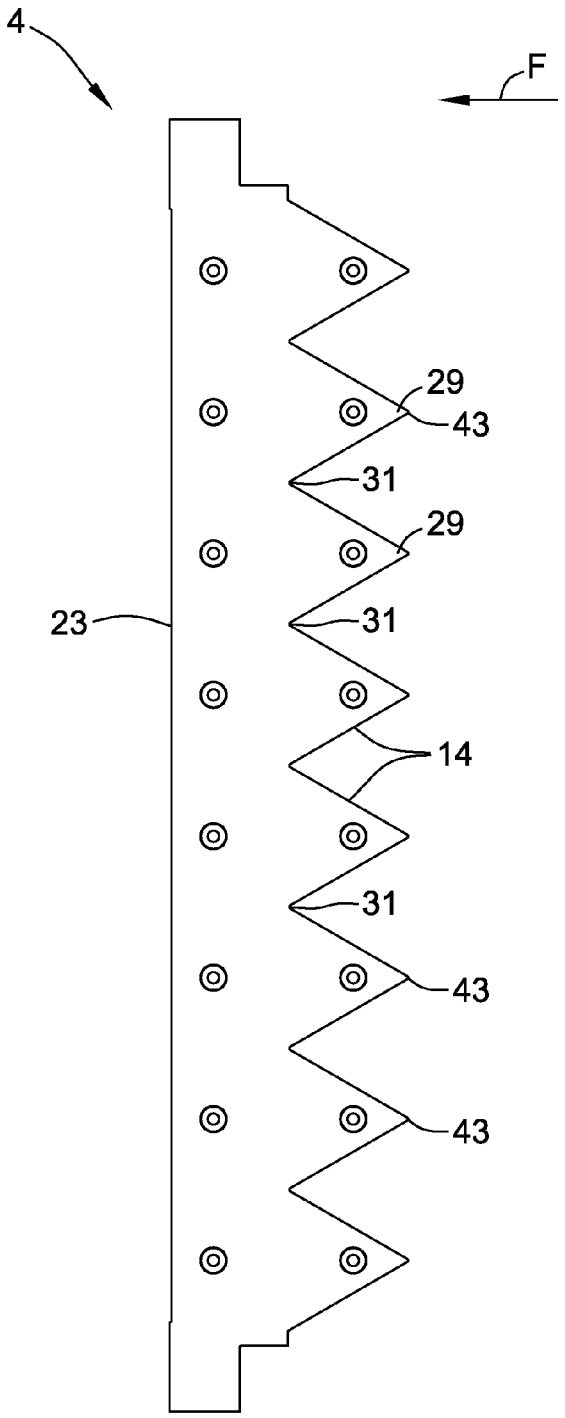
FIG. 7 is a top view of a second top plate of the anvil.
Figure 10:
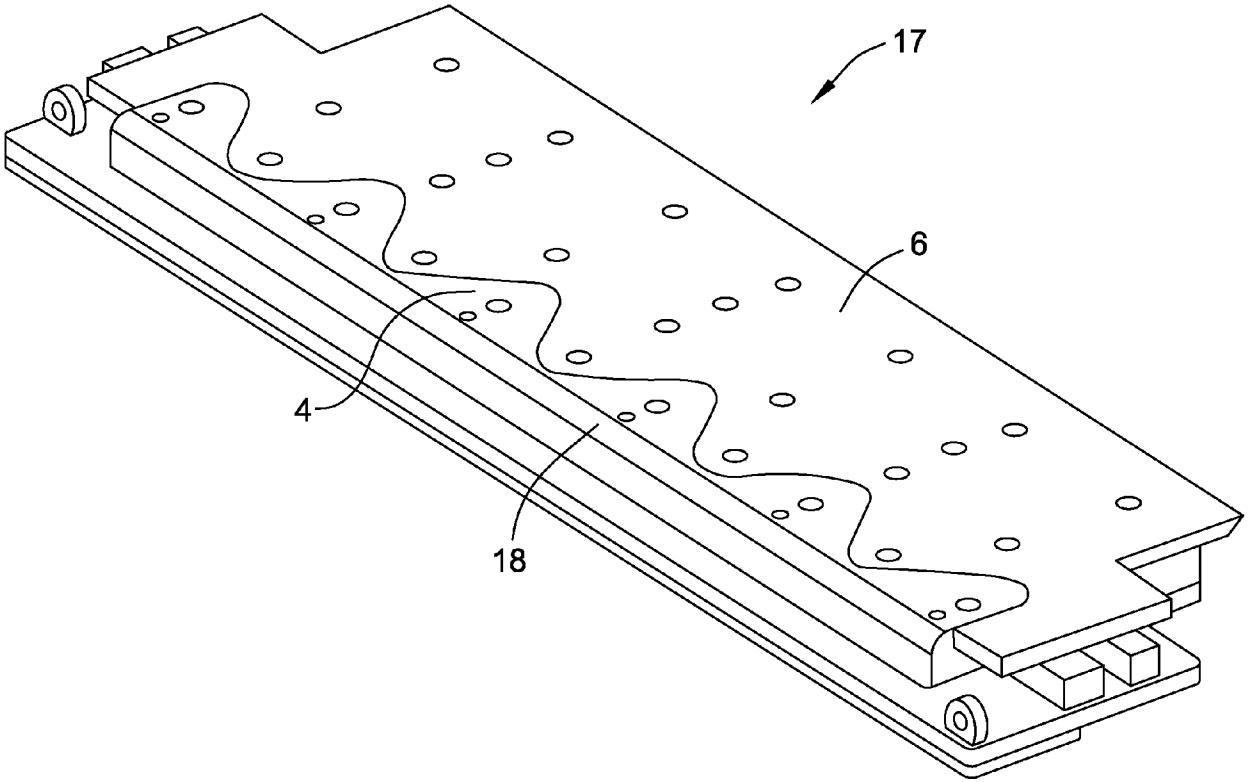
FIG. 10 is perspective view of a second embodiment of an anvil with rounded edges.

As shown in FIGS. 6-7, the projections 29, 39 terminate in a point 43, 45. However, the projections 29, 39 may also be rounded (FIG. 10) or have other suitable shapes. In embodiments in which the projections 29, 39 are rounded, the radius of curvature of the projections and indentations may be less than about 0.5 cm (about 0.2 inches).

The anvil 17 includes a shear edge 18 (FIG. 4) for comminuting material as the comminuting drum 25 rotates. The shear edge 18 is formed on an edge member 19. As the drum 25 rotates, material is gripped between the reducing elements 3 and the shear edge 18 and the rotational force of the drum 25 causes the material to be comminuted. The shear edge 18 is positioned near the second end 27 of the anvil 17. During use, a radial offset (i.e., clearance) is defined between the reducing elements (FIG. 2) and the shear edge 18.

Figure 11:
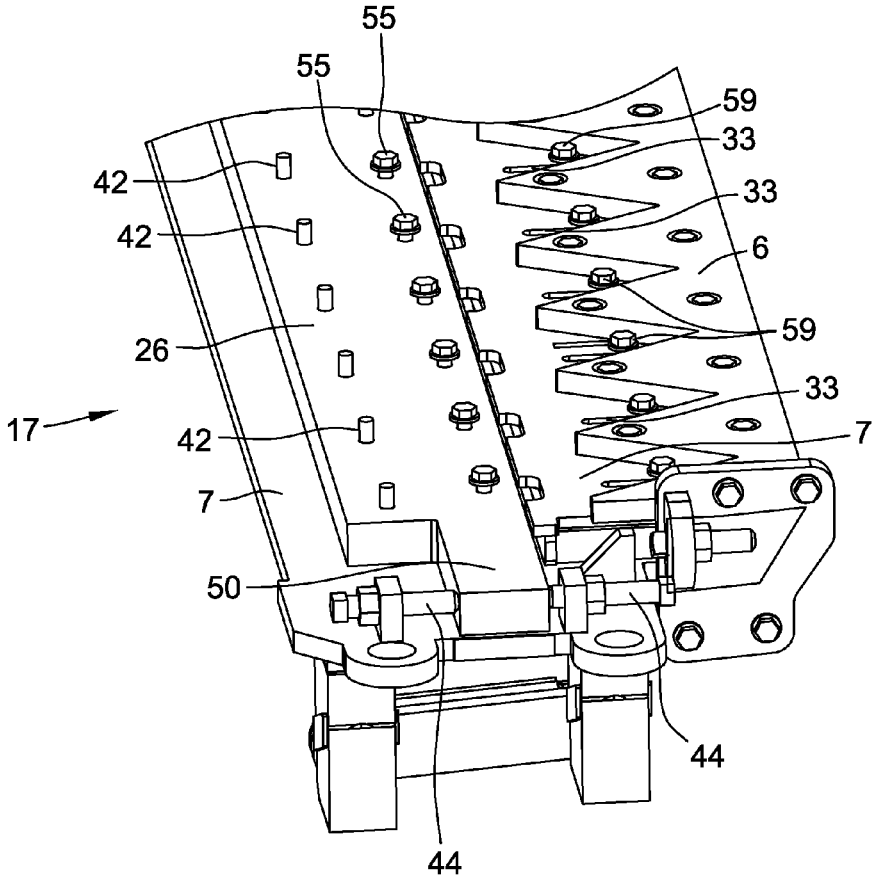
FIG. 11 is a perspective view of the anvil of FIG. 4 with the second top plate not shown.

Referring now to FIG. 11 (the second top plate and edge member not being shown), the anvil 17 includes a support plate 26 configured for mounting to the second top plate and edge member (FIG. 4) such that the edge member 19 is mounted adjacent the second top plate 4 opposite the leading edge 14 of the second top plate. As shown in FIG. 11, the edge member may be mounted by use of threaded bolts 42. The first top plate 6 is mounted to a base 7 that extends across the trailing edge 16 (FIG. 6) of the first top plate 6 and the leading edge 14 (FIG. 7) of the second top plate 4 and extends beneath the support plate 26.

Figure 12:
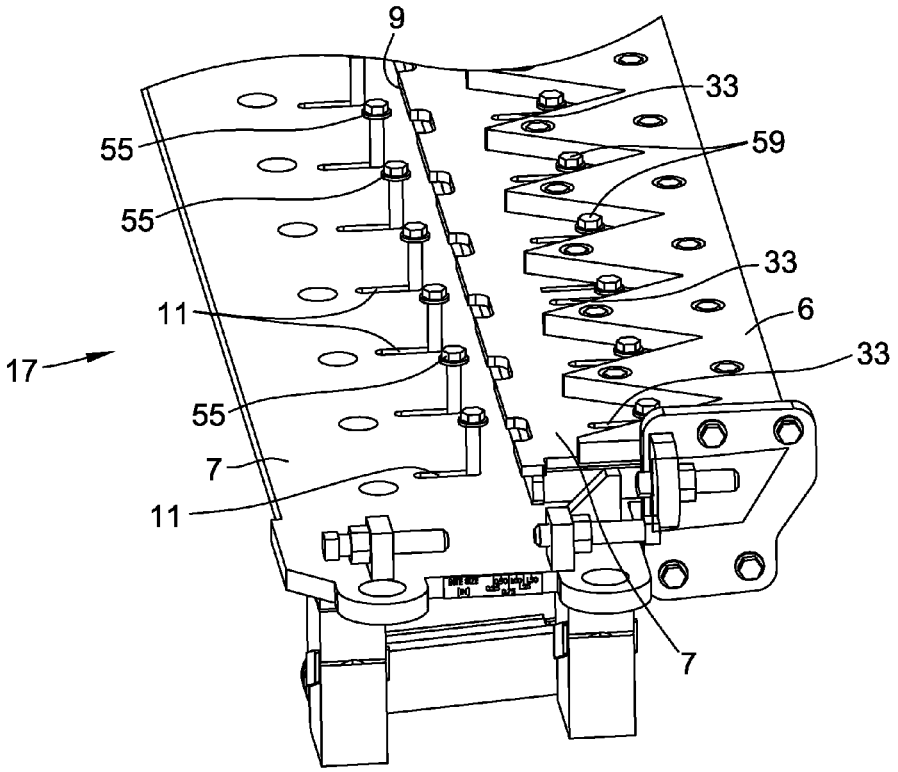
FIG. 12 is a perspective view of the anvil with the second top plate and support plate not shown.

As shown in FIG. 12, the base 7 includes a ledge 9 adjacent the support plate 26 (FIG. 11). The base 7 may be integral (e.g., the ledge and base surfaces may be attached such as by welding) or the anvil 17 may include various separate components that together form the base 7. The second top plate 4 and support plate 26 are adjustably mounted to the base 7. The second top plate 4 may be moved relative to the base 7 by use of first row of lengthwise openings or "through-slots" 33 (FIG. 12) and second row of lengthwise through-slots 11 that extend through the base 7 and are generally perpendicular to the shear edge 18 (FIG. 4). In this manner, the support plate 26 and ledge 9 of the base 7 form an adjustable-length support plate margin 61 having a length $L_1$ (FIG. 13). Alternatively or in addition, the second top plate 4 may include lengthwise through-slots (not shown) that are generally perpendicular to the shear edge for adjusting the relative position of the second top plate 4 and first top plate 6 (i.e., the length of the margin between the first top plate 6 and second top plate 4). It should be noted that a series of through-holes may be substituted for the through-slots formed in the anvil 17 for relative adjustment of the anvil components.

The second top plate 4 and first top plate 6 form a margin 63 (FIG. 13) having a length $L_2$. In embodiments in which projections and indentations extend across the length of the second top plate 4 and first top plate 6, no portion of the adjustable length margin 63 is parallel to the shear edge 18 and no portion of the adjustable length margin is perpendicular to the shear edge 18. The margin 61 between the support plate 26 and ledge 9 of the base 7 is offset from the margin 63 between the first top plate 6 and second top plate 4.

As shown in FIG. 9, a first top plate serrated area $A_6$ is defined by the projections 45 and indentations 41 of the first top plate 6 and a second top plate serrated area $A_4$ is defined by the projections 43 and indentations 31 of the second top plate 4. Generally, adjustment of the length of the margin between the first plate 6 and second plate 4 is limited such that the area $A_6$ of the first top plate 6 remains overlapped with the area $A_4$ of the second top plate 4.

Referring now to FIG. 12 (second top plate, edge member and support plate not being shown), the base 7 is configured for mounting to the second top plate, edge member and support plate. The first row of lengthwise through-slots 11 and the second row of lengthwise through-slots 33 may be used to adjust the position of the second top plate, edge member and support plate relative to the base 7 and top plate 6. The support plate 26 (FIG. 11) and elements attached thereto may be adjusted relative to the base 7 by loosening bolts 55, 59 that extend through through-slots 11, 33 of the base 7. Bolts 42, 55, 59 may be fastened to nut bars 56*a*, 56*b*, 56*c* disposed beneath the base 7.

Figure 14:
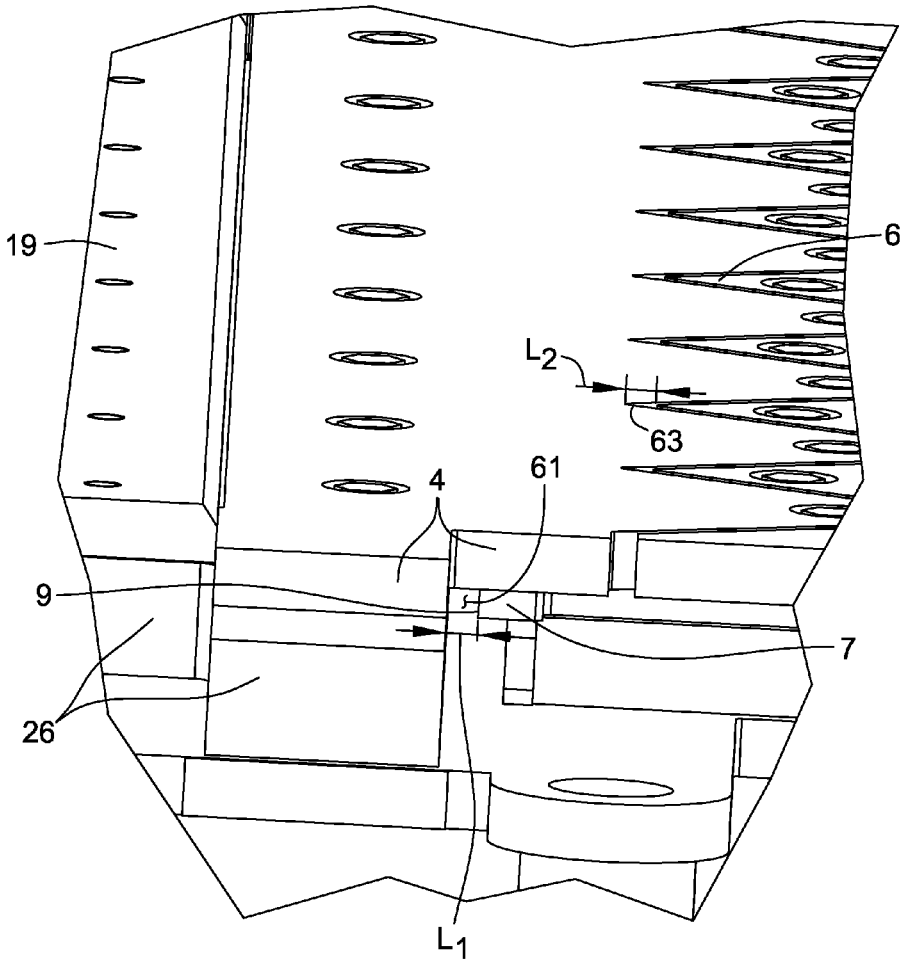
FIG. 14 is a perspective view of the anvil showing a wider top plate margin and support plate margin relative to FIG. 13.

Upon loosening bolts 55, 59, push bolts 44 (FIG. 11) that contact an arm 50 of the support plate 26 on each side of the anvil 17 may be rotated to adjust the position of the support plate, second top plate and edge member relative to the base 7. For example and as shown in FIG. 14, the margins 61, 63 may be made relatively wider than the margins 61, 63 of FIG. 13. Once repositioning to achieve the desired length $L_1$, $L_2$ of margins 61, 63 takes place, the bolts 55, 59 and push bolts 44 may be retightened to maintain the desired alignment.

The apparatus 5 (FIG. 1) is operable to reduce the size of material such as tree limbs, stumps or brush in land-clearing, municipal waste, composted materials or other vegetation, building materials or recycled material (e.g., car tires and the like). Material is conveyed on the in-feed system 13 (FIG. 2) toward the adjustable anvil 17 and is driven over the anvil toward the comminuting drum 25. As the drum 25 rotates, material is impacted and reduced in size and is forced through a clearance between the reducing elements 3 mounted on the drum and the edge member 19.

Use of the apparatus 5 may cause the shear edge 18 (FIG. 4) of the edge member 19 to become worn causing the clearance between the shear edge and the reducing elements 3 to increase. Such an increase in clearance may cause the product size to be increased to an undesirable amount. When it is desired to decrease the clearance between the shear edge 18 and the reducing elements 3, the bolts 55, 59 (FIG. 11) which secure the second top plate 4 and support plate 26 (FIG. 4) may be loosened and the push bolts 44 (FIG. 11) may be rotated to cause the length $L_1$, $L_2$ of the margins 61, 63 (FIG. 13) to increase, thereby increasing the length of the anvil 17. After the material is reduced in size, the discharge conveyor 40 (FIG. 1) carries the comminuted material to a desired collection location (e.g., a pile, bin, truck bed, etc.).

It should be noted that while the length $L_2$ of the margin 63 between the first top plate 6 and second top plate 4 may be adjusted by manipulating the position of the support plate 26 as described herein, the length of the margin may be adjusted by methods and anvil arrangements other than as described herein without departing from the scope of the present disclosure. In some embodiments (e.g., when an anvil having an unworn edge member is used), the length $L_2$ of the margin 63 is zero (i.e., the first top plate 4 and second top plate 6 are in an abutting relationship).

Compared to conventional apparatus for comminuting material, the apparatus described above has several advantages. For example, use of an anvil 17 (FIG. 4) with a first top plate 6 that may be moved relative to a second top plate 4 allows the length of the anvil to be adjusted such as after the edge member 19 has become worn. Accordingly, a relatively consistent clearance length between the anvil and the comminuting drum may be maintained. This capability allows the shear edge 18 (FIG. 4) of the anvil 17 to be kept in an appropriate cutting zone while preventing a large gap at the leading edge 22 of the first plate 6 (i.e., a large gap with the in-feed conveyor 15 (FIG. 2)) where material may otherwise become lodged. That is, an acceptable gap may be formed in the anvil mid-section, rather than forming such a break between the anvil and in-feed conveyor.

Further, the use of a second top plate 4 and support plate 26 that are adjustable relative to the first top plate 6 and ledge 9 of the base 7 allows the top-plate margin 63 and support plate margin 61 (FIG. 13) to be non-aligned. Accordingly, debris is prevented from falling within the support-plate margin 61. Use of a first top plate 6 and second top plate 4 that have aligned projections and indentations (e.g., that form a "zig-zag" pattern) prevents elongated debris (e.g., sticks or twigs) from being trapped within the top plate margin 63 (FIG. 13). In embodiments in which the projections 29, 39 (FIGS. 6 and 7) are rounded, using projections 29, 39 with a radius of curvature of less than about 0.5 cm (about 0.2 inches) also prevents elongated debris from being trapped within the top plate margin 63 (FIG. 13).

As used herein, the terms "about," "substantially," "essentially" and "approximately" when used in conjunction with ranges of dimensions, concentrations, temperatures or other physical or chemical properties or characteristics is meant to cover variations that may exist in the upper and/or lower limits of the ranges of the properties or characteristics, including, for example, variations resulting from rounding, measurement methodology or other statistical variation.

When introducing elements of the present disclosure or the embodiment(s) thereof, the articles "a", "an", "the" and "said" are intended to mean that there are one or more of the elements. The terms "comprising," "including," "containing" and "having" are intended to be inclusive and mean that there may be additional elements other than the listed elements. The use of terms indicating a particular orientation (e.g., "top", "bottom", "side", etc.) is for convenience of description and does not require any particular orientation of the item described, unless otherwise expressly stated to the contrary.

As various changes could be made in the above constructions and methods without departing from the scope of the disclosure, it is intended that all matter contained in the above description and shown in the accompanying drawing[s] shall be interpreted as illustrative and not in a limiting sense.

What is claimed is:

1. An adjustable anvil for a comminuting apparatus, the adjustable anvil comprising:

a first plate having a trailing edge;

a second plate having a leading edge, the first plate and second plate forming an anvil work surface for bringing material into contact with a comminuting drum, the trailing edge of the first plate being adjacent the leading edge of the second plate, the trailing edge of the first plate and leading edge of the second plate being serrated; and a margin disposed between the trailing edge of the first plate and leading edge of the second plate and having an adjustable length.

2. The adjustable anvil as set forth in claim 1 wherein the serrated trailing edge of the first plate includes a plurality of projections and indentations and the serrated leading edge of the second plate includes a plurality of projections and indentations, the projections of the trailing edge being aligned with the indentations of the leading edge and the indentations of the trailing edge being aligned with the projections of the leading edge.

3. The adjustable anvil as set forth in claim 2 wherein the projections of the first top plate define a serrated area and the projections of the second top plate define a serrated area, the serrated area of the first top plate overlapping the serrated area of the second top plate.

4. The adjustable anvil as set forth in claim 1 wherein the projections and/or indentations are rounded.

5. The adjustable anvil as set forth in claim 1 wherein the projections and/or indentations are pointed.

6. The adjustable anvil as set forth in claim 1 further comprising a shear edge for comminuting material and a base to which the first plate is mounted, the base including lengthwise through-slots for adjusting the length of the margin, the through-slots being generally perpendicular to the shear edge.

7. The adjustable anvil as set forth in claim 6 comprising push bolts for adjusting the length of the margin.

8. The adjustable anvil as set forth in claim 1 comprising a support plate to which an edge member having a shear edge for comminuting material and the second plate are mounted, the edge member being mounted adjacent the second plate opposite the leading edge of the second plate.

9. The adjustable anvil as set forth in claim 8 comprising a base to which the first plate is mounted, the support plate and base being capable of forming an adjustable-length support plate margin, the support plate margin being offset from the margin between the first plate and second plate.

10. The adjustable anvil as set forth in claim 8 wherein the base extends across the leading edge of the second plate and the trailing edge of the first plate.

11. The adjustable anvil as set forth in claim 1 further comprising a shear edge for comminuting material, wherein the second plate includes lengthwise through-slots for adjusting the length of the margin, the through-slots being generally perpendicular to the shear edge.

12. The adjustable anvil as set forth in claim 1 wherein the length of the margin is zero.

13. A material comminuting apparatus comprising:

a comminuting drum;

an in-feed system, the system including an endless conveyor to move material towards the comminuting drum in a feed direction;

an adjustable anvil as set forth in claim 1, the adjustable anvil disposed between the in-feed system and the comminuting drum and having a surface that supports the materials.

14. A method for reducing the size of material by use of a comminuting apparatus comprising an in-feed system, an adjustable anvil and a comminuting drum, the method comprising:

conveying material on the in-feed system toward the adjustable anvil as set forth in claim 1;

driving the material over the anvil and toward the comminuting drum;

rotating the drum to comminute material by forcing material through a clearance between the drum and a shear edge of an edge member of the adjustable anvil.

15. The method as set forth in claim 14 further comprising adjusting the length of the anvil to reduce the clearance between the drum and the shear edge.

16. The method as set forth in claim 14 wherein the material is arboraceous material.

17. An adjustable anvil for a comminuting apparatus, the adjustable anvil comprising:

a first plate having a trailing edge;

a second plate having a leading edge, the first plate and second plate forming an anvil work surface for bringing material into contact with a comminuting drum, the trailing edge of the first plate being adjacent the leading edge of the second plate; and a margin disposed between the trailing edge of the first plate and leading edge of the second plate and having an adjustable length, the margin including a zig-zag pattern.

18. The adjustable anvil as set forth in claim 17 comprising a support plate to which an edge member having a shear edge for comminuting material and the second plate are mounted, the edge member being mounted adjacent the second plate opposite the leading edge of the second plate.

19. The adjustable anvil as set forth in claim 18 comprising a base to which the first plate is mounted, the support plate and base being capable of forming an adjustable-length support plate margin, the support plate margin being offset from the margin between the first plate and second plate.

20. An adjustable anvil for a comminuting apparatus, the adjustable anvil comprising:

a first plate having a trailing edge;

a second plate having a leading edge, the first plate and second plate forming an anvil work surface for bringing material into contact with a comminuting drum, the trailing edge of the first plate being adjacent the leading edge of the second plate;

a margin disposed between the trailing edge of the first plate and leading edge of the second plate and having an adjustable length; and a shear edge for comminuting material wherein (1) no portion of the adjustable-length margin is parallel to the shear edge and/or (2) no portion of the adjustable-length margin is perpendicular to the shear edge.

* * * * *